US011464271B2

(12) United States Patent
Jacob

(10) Patent No.: US 11,464,271 B2
(45) Date of Patent: Oct. 11, 2022

(54) ENERGY DISSIPATING HELMET

(71) Applicant: William J. Jacob, Kansas City, MO (US)

(72) Inventor: William J. Jacob, Kansas City, MO (US)

(73) Assignee: William A. Jacob, Kansas City, MO (US)

( * ) Notice: Subject to any disclaimer, the term of this patent is extended or adjusted under 35 U.S.C. 154(b) by 514 days.

(21) Appl. No.: 13/894,423

(22) Filed: May 14, 2013

(65) Prior Publication Data

US 2013/0298316 A1 Nov. 14, 2013

Related U.S. Application Data

(60) Provisional application No. 61/646,596, filed on May 14, 2012.

(51) Int. Cl.
*A42B 3/12* (2006.01)

(52) U.S. Cl.
CPC ..... *A42B 3/12* (2013.01); *A42B 3/125* (2013.01)

(58) Field of Classification Search
CPC ..... A42B 3/12; A42B 3/121; A42B 3/125; A42B 3/128; A42B 3/127; A42B 3/06; A42B 3/061; A42B 3/062; A42B 3/063; A42B 3/069; A42B 3/068; A63B 71/10
USPC ..... 2/414, 425
See application file for complete search history.

(56) References Cited

U.S. PATENT DOCUMENTS 2,140,716 A * 12/1938 Pryale ..... A42B 3/12 2/414
2,878,478 A * 3/1959 Kleinman ..... A42B 3/06 2/414
3,174,155 A * 3/1965 Pitman ..... A42B 3/069 2/411
3,197,784 A 8/1965 Carlisle
3,616,463 A * 11/1971 Theodore et al. ..... A42B 3/128 2/412
3,815,152 A * 6/1974 Bednarczuk ..... A42B 3/069 2/9
4,223,409 A * 9/1980 Lee ..... A42B 3/065 2/411
4,476,589 A * 10/1984 Burgin ..... A42C 5/04 2/184.5
4,566,137 A * 1/1986 Gooding ..... A42B 3/122 2/413
4,754,501 A * 7/1988 Yahn ..... A42B 3/20 2/424
4,845,786 A * 7/1989 Chiarella ..... A42B 3/065 2/412
4,937,888 A * 7/1990 Straus ..... A42B 3/003 2/411

(Continued)

FOREIGN PATENT DOCUMENTS

WO WO 2006041355 A1 * 4/2006 ..... A42B 3/063

*Primary Examiner* — Alissa L Hoey
(74) *Attorney, Agent, or Firm* — Stinson LLP

(57) ABSTRACT

An energy dissipating helmet, such as a football, baseball, hockey, construction, combat, bicycle, or motorcycle helmet, including a structural component adapted to receive an anticipatory impact having energy, and a stress-activated active material element, such as a Austenitic shape memory alloy wire, mesh, layer, or spring, communicatively coupled to the component, and activatable by the impact, so as to dissipate at least a portion of the energy.

15 Claims, 3 Drawing Sheets

(56) References Cited

U.S. PATENT DOCUMENTS 5,018,220 A * 5/1991 Lane ..... A42B 3/063 2/5
5,204,998 A * 4/1993 Liu ..... A42B 3/121 2/411
5,271,103 A * 12/1993 Darnell ..... A42B 1/08 2/411
5,272,773 A * 12/1993 Kamata ..... A42B 3/066 2/421
5,309,576 A * 5/1994 Broersma ..... A42B 3/128 2/412
5,598,588 A * 2/1997 Lee ..... A42B 3/08 2/421
5,713,082 A * 2/1998 Bassette ..... A42B 3/061 2/412
5,745,923 A * 5/1998 Katz ..... A42B 3/00 2/411
5,794,271 A * 8/1998 Hastings ..... A42B 3/061 2/412
5,940,889 A * 8/1999 Shirai ..... A42B 3/283 2/171.3
5,950,244 A * 9/1999 Fournier ..... A42B 3/128 2/411
5,956,777 A * 9/1999 Popovich ..... A42B 3/065 2/412
6,012,178 A * 1/2000 Schuster ..... A42B 3/063 2/2.5
6,058,515 A * 5/2000 Kitahara ..... A42B 3/128 2/412
6,154,889 A 12/2000 Moore et al.
6,219,850 B1 * 4/2001 Halstead ..... A42B 3/06 2/414
6,272,692 B1 * 8/2001 Abraham ..... A42B 3/063 2/411
6,282,724 B1 * 9/2001 Abraham ..... A41D 13/015 2/267
6,301,718 B1 * 10/2001 Rigal ..... A42B 3/046 2/411
6,314,586 B1 * 11/2001 Duguid ..... A42B 3/069 2/411
6,332,226 B1 * 12/2001 Rush, III ..... A42B 3/0433 2/412
6,389,607 B1 * 5/2002 Wood ..... A42B 3/00 2/411
6,857,135 B2 * 2/2005 Sumitomo ..... A42B 3/281 2/171.3
6,910,714 B2 6/2005 Browne et al.
7,108,316 B2 9/2006 Barvosa-Carter et al.
7,140,478 B2 11/2006 Barvosa-Carter et al.
7,152,253 B2 * 12/2006 Abelman ..... A42B 3/08 2/421
7,264,271 B2 9/2007 Barvosa-Carter et al.
7,267,367 B2 9/2007 Barvosa-Carter et al.
7,341,776 B1 * 3/2008 Milliren ..... A41D 13/05 2/411
7,509,835 B2 * 3/2009 Beck ..... A42B 3/046 2/425
7,975,317 B2 * 7/2011 Rampell ..... A42B 1/008 2/195.1
8,047,572 B2 11/2011 Barvosa-Carter et al.
8,623,490 B2 1/2014 Lin et al.
8,707,470 B1 * 4/2014 Novicky ..... A42B 3/06 2/411
8,950,735 B2 * 2/2015 Reynolds ..... F16F 1/376 2/413
9,089,180 B2 * 7/2015 Phipps ..... A42B 3/12
9,474,318 B2 * 10/2016 Wesson ..... A42B 3/125
2002/0004947 A1 * 1/2002 Bacchiega ..... A41D 31/0061 2/412
2004/0250337 A1 * 12/2004 Pietrzykowski ..... A42B 1/004 2/195.3
2005/0015855 A1 * 1/2005 Skiba ..... A42B 3/063 2/412
2005/0177918 A1 * 8/2005 Liu ..... A42B 3/28 2/7
2006/0059606 A1 * 3/2006 Ferrara ..... A01N 25/18 2/412
2006/0112477 A1 * 6/2006 Schneider ..... A42B 3/063 2/412
2007/0099524 A1 * 5/2007 Porter ..... B32B 5/24 442/38
2007/0190293 A1 * 8/2007 Ferrara ..... B29C 45/0053 428/166
2008/0086916 A1 * 4/2008 Ellis ..... A43B 7/1425 36/103
2008/0256686 A1 * 10/2008 Ferrara ..... A41D 13/0155 2/413
2009/0044315 A1 * 2/2009 Belanger ..... A42B 3/324 2/414
2009/0106882 A1 * 4/2009 Nimmons ..... A42B 3/16 2/414
2009/0266663 A1 * 10/2009 Lin ..... A42B 3/063 188/372
2010/0134365 A1 * 6/2010 Mohamadi ..... A42B 3/0433 343/718
2010/0287687 A1 * 11/2010 Ho ..... A42B 3/061 2/411
2011/0047680 A1 * 3/2011 Hoying ..... A42B 3/069 2/414
2011/0117369 A1 * 5/2011 DeRudder ..... B32B 27/08 428/412
2011/0225706 A1 * 9/2011 Pye ..... A42B 1/004 2/411
2011/0229685 A1 * 9/2011 Lin ..... B32B 3/12 428/117
2012/0017358 A1 * 1/2012 Princip ..... A42B 3/064 2/414
2012/0036619 A1 * 2/2012 Ytterborn ..... A42B 3/063 2/411
2012/0151663 A1 * 6/2012 Rumbaugh ..... A42B 3/065 2/411
2012/0204327 A1 * 8/2012 Faden ..... A41D 31/005 2/411
2012/0317705 A1 * 12/2012 Lindsay ..... A42B 3/20 2/413
2013/0232668 A1 * 9/2013 Suddaby ..... A42B 3/121 2/413
2013/0283503 A1 * 10/2013 Zilverberg ..... A42B 3/04 2/411
2013/0283504 A1 * 10/2013 Harris ..... A42B 3/069 2/411
2013/0298317 A1 * 11/2013 Fonte ..... A41D 13/015 2/414
2014/0223643 A1 * 8/2014 Infusino ..... A42B 3/122 2/413
2014/0223646 A1 * 8/2014 Bologna ..... A42B 3/20 2/424
2015/0013051 A1 * 1/2015 Shapiro ..... A42B 3/285 2/421
2015/0143617 A1 * 5/2015 Suddaby ..... A42B 3/124 2/414

* cited by examiner

ENERGY DISSIPATING HELMET

CROSS REFERENCE TO RELATED APPLICATIONS

This U.S. Non-Provisional patent application claims priority to and the benefit of U.S. Provisional application Ser. No. 61/646,596 and filed on May 14, 2012, the disclosure of which being incorporated by reference herein.

BACKGROUND

1. Field of the Invention

The present disclosure relates to protective helmets, and more particularly to a protective helmet that utilizes stress induced active material activation to dissipate energy during an impact.

2. Discussion of Prior Art

A variety of protective helmets have been developed to protect a user against injury resulting from an impact to the head, as often required by law. For example, in the sports of football, hockey, and baseball, players typically don helmets during play to protect their head, neck, face, and spine from catastrophic injury, which may result from an impact by another player or the ground during a tackle, by a baseball pitch gone awry, etc. Construction of these helmets typically include a rigid outer shell formed of an injected molded hard plastic, and interior padding typically formed of vinyl, foam, polypropelene, or similar material that absorb energy mechanically.

Conventional helmets have been shown to effectively protect against some injuries, such as skull fractures, but present various concerns in other areas even when used properly. For example, concussions and spinal injury remain problematic, especially in football, due to the transfer of energy to the player. More particularly, it has been reported that at least 43,000 high-school football players in the United States suffer concussions each year; and despite special rules that prevent "spearing," spinal cord injuries remain a concern, especially in secondary school and younger aged players who often do not possess the necessary skill to execute a proper form tackle.

Thus, there remains a need in the art for an improved protective helmet that, among other things, reduces the likelihood of concussions and spinal injury.

BRIEF SUMMARY

The present invention concerns a protective helmet adapted for use by a user, to receive an anticipatory impact having energy, to absorb at least a portion of the energy, so as to not transfer said portion of the energy to the user, and to facilitate repair. The helmet comprises a structural component presenting an original shape, and configured to receive and be elastically or inelastically deformed by the impact, so as to absorb said portion of the energy. In some embodiments, the helmet employs a stress activated active material element to dissipate energy during an impact. The invention is useful for reducing the amount of energy that is transferred to the head, neck, and/or spine of a user, and therefore, for reducing the likelihood of injuries, including concussions and spinal injury that may occur from an impact to the head of a user. Whereas conventional helmets temporarily absorb energy through resistive compression of various foams or padding materials and subsequently release the stored energy (to the user or helmet) through decompression and equilibration once the impact subsides, the present invention provides a novel method of dissipating energy (i.e., removing at least a portion of the energy from the transfer all together). That is to say, by storing and later releasing at least a portion of the energy from an impact via the hysteresis loop of the active material, the invention is useful for removing said at least portion from the transfer of energy to the user.

The invention is useful for mitigating sudden stop conditions that cause concussions and other injuries. That is to say, while the hysteresis loop of the material as it goes from Austenite to Martensite and then back to Austenite defines the amount of energy dissipated (the higher above Af the more energy required to transform), another benefit of the invention is in concussion prevention. In a preferred embodiment, transformation to the more malleable state will occur at some point during head travel/padding compression, thereby making it easier to continue to travel/compress. This is contrary and advantageous to conventional helmet padding materials that apply increasingly greater resistance as they are compressed even though the user is decelerating, which accelerates the stop. In the present invention, transformation results in greater resistance at the beginning (when acceleration is greatest), and reduced resistance at a subsequent point, where acceleration has lessened. Moreover, greater travel is enabled, where the inventive interior padding is able to achieve a thinner collapsed profile in its Martensitic form than a resistively equivalent conventional pad. Thus, by reducing the resistance offered by the pad during impact, and increasing the available travel distance, concussions are deterred.

As a result, the invention is useful for improving the safety of users during activities, such as playing football, baseball, or hockey, conducting military, factory, or construction operations, or operating a bicycle, motorcycle, or all-terrain-vehicle (ATV), and therefore for providing psychological reassurance to the user, family members of the user, and others during such activities. The invention is yet further useful for providing a method of retrofitting or reconditioning existing helmets in a manner that improves upon their original functionality. Finally, in a preferred embodiment, the invention may be used to produce an alert that an impact has occurred, and therefore may be used as a training tool to teach, for example, proper tackling technique.

In general, the invention presents an energy-dissipating helmet adapted for use by a user, to receive an anticipatory impact having energy, and to dissipate at least a portion of the energy, so as to not transfer the portion of energy to the user. The helmet includes a structural component configured to receive the impact, and an active material element, such as a normally Austenitic shape memory alloy wire, mesh, matrix, or spring, operable to undergo a reversible change in fundamental property when exposed to a stress activation signal. The element is communicatively coupled to the component and configured such that it receives the impact, the impact produces the stress activation signal, and the change in fundamental property causes the dissipation of energy.

Other aspects and advantages of the present invention, including embodiments wherein various active material elements compose the shell, interior padding, or facemask may be understood more readily by reference to the following detailed description of the various features of the disclosure and the examples included therein.

BRIEF DESCRIPTION OF THE DRAWINGS

Preferred embodiments of the invention are described in detail below with reference to the attached drawing figures of exemplary scale, wherein.

DETAILED DESCRIPTION

Figure 2A:
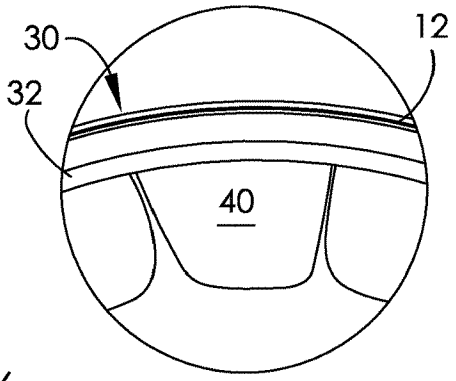
FIG. 2*a* is an exemplary cross-section of an energy dissipating section taken along lines A-A in FIG. 1, illustrating an outer shell formed by outer and inner layers spaced by air, and interior padding comprising non-active cushion material, wherein the outer layer includes an active material continuous sheet, in accordance with a preferred embodiment of the invention.
Figure 2:
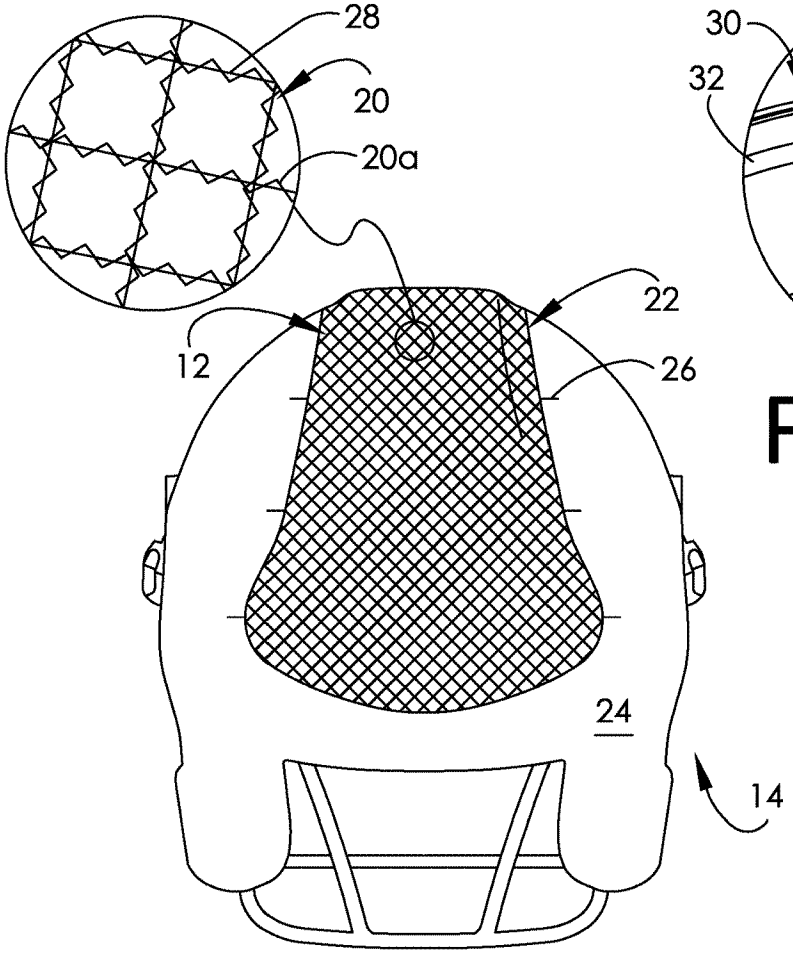
FIG. 2 is a back elevation of the football helmet shown in FIG. 1, further illustrating the sections, and in enlarged caption view, the active mesh.
Figure 1:
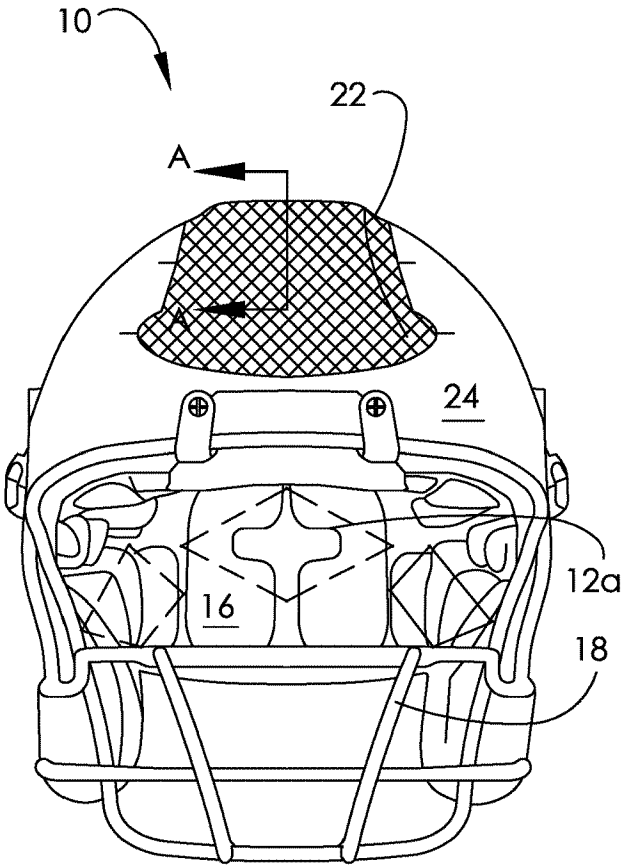
FIG. 1 is a front elevation of a football helmet comprising a rigid outer shell presenting dorsal energy dissipating and side non-active sections inter-engaged by a plurality of pins, and an active material mesh disposed within the energy dissipating section, and further comprising interior padding having Austenitic SMA wire (shown in hidden-line type) entrained within its cushion material and fixedly anchored by the shell, in accordance with a preferred embodiment of the invention.
Figure 3:
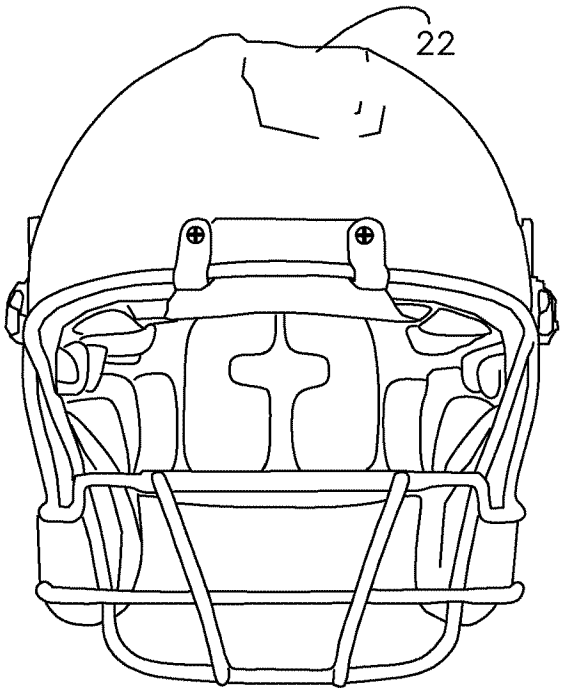
FIG. 3 is a front elevation of the football helmet shown in FIG. 1 after an impact has caused a deformation in the energy dissipating section.

Turning to FIGS. 1-10, the present invention concerns a protective helmet 10 operable to dissipate energy and effect that aforementioned benefits. In the exemplary embodiment shown in FIGS. 1, 2, and 3, the helmet may present a conventional football configuration, presenting a front elevation and a back elevation, and including a left side portion, a right side portion, and a dorsal portion intermediate the left side portion and the right side portion, said dorsal portion defining a crown, wherein the left side portion, the dorsal portion, and the right side portion are laterally adjacent and cooperatively define an exterior surface. As shown in FIGS. 1 and 3, the left side portion, the right side portion, and the dorsal portion may cooperatively define, in the front elevation, an inverted U-shaped opening operable to receive a facemask, wherein the opening is defined by opposite vertical edges defined by the left side portion and the right side portion and an interconnecting cross-edge defined by the left side portion, the right side portion, and the dorsal portion. In some embodiments, the helmet employs stress activated active material actuation to dissipate energy during an impact. More particularly, the helmet 10 is adapted for use by a user (not shown) during an activity, and configured to receive an anticipatory impact producing a total energy and dissipate at least a portion of the energy, so as to not transfer the portion to the user, wherein an "anticipatory impact" is an impact of type and magnitude typically encountered during the activity. The helmet 10 generally employs a stress-activated active material element 12 to receive the impact, convert at least a portion of its energy into a stress activation signal, and dissipate energy by using the signal to reversibly and spontaneously transform the active material as further described below. The element 12 dissipates a minimum portion, more preferably, at least 10%, and most preferably, at least 25% of the energy, so as to effect a measurable impact upon the impact. Finally, it is appreciated that the advantages and benefits of the present invention may be applied wherever protective helmets are used; for example, the invention may be used in association with football, baseball, hockey, lacrosse, and other contact sports, while operating a bicycle, motorcycle, ATV, or other vehicle, and while working in potentially injurious settings, such as construction, factory, and military/combat applications.

An active material particularly suited for use in the present invention is shape memory alloy in a normally Austenite phase (i.e., having a phase transition temperature less than ambient temperature); however, it is well within the ambit of the invention to utilize any stress-activated active material, as equivalently presented herein, or modified as necessary. As used herein the term "active material" is to be given its ordinary meaning as understood and appreciated by those of ordinary skill in the art; and thus includes any material or composite that undergoes a reversible fundamental (e.g., intensive physical, chemical, etc.) property change when activated by an external stimulus or signal.

Shape memory alloys (SMA's) generally refer to a group of metallic active materials that demonstrate the ability to return to some previously defined shape or size when subjected to an appropriate thermal stimulus. Shape memory alloys are capable of undergoing phase transitions in which their yield strength, stiffness, dimension and/or shape are altered as a function of temperature, and therefore, exist in several different temperature-dependent phases. The most commonly utilized of these phases are Martensite and Austenite phases. The Martensite phase generally refers to the more deformable, lower temperature phase whereas the Austenite phase generally refers to the more rigid, higher temperature phase. When the shape memory alloy is in the Martensite phase and is heated, it begins to change into the Austenite phase and recover a "memorized" shape. The temperature at which this phenomenon starts is often referred to as Austenite start temperature ($A_s$). The temperature at which this phenomenon is complete is called the Austenite finish temperature ($A_f$).

In the Austenite phase, a stress induced phase change to the Martensite phase exhibits a superelastic (or pseudoelastic) behavior that refers to the ability of SMA to return to its original shape upon unloading after a substantial deformation in a two-way manner. That is to say, application of increasing stress when SMA is in its Austenitic phase will cause the SMA to exhibit elastic Austenitic behavior until a certain point where it is caused to change to its lower modulus Martensitic phase, where it then exhibits elastic Martensitic behavior followed by up to 8% of superelastic deformation. Removal of the applied stress will cause the SMA to switch back to its Austenitic phase in so doing recovering its starting shape and higher modulus, as well as dissipating energy under the hysteretic loading/unloading stress-strain loop. Moreover, it is appreciated that the application of an externally applied stress causes Martensite to form at temperatures higher than $M_s$. Superelastic SMA can be strained several times more than ordinary metal alloys without being plastically deformed, however, this is only observed over a specific temperature range, with the largest ability to recover occurring close to $A_f$.

Returning to the structural configuration of the helmet 10, the active material element 12 is communicatively coupled to or composes any structural component (i.e., predetermined area) of the helmet 10 that is anticipated to receive an anticipatory impact. Inventively, the active material element 12, such as a Austenitic (or "superelastic") shape memory alloy wire, mesh, layer, or spring, is activated by the impact, and more particularly, by stress induced therefrom, so as to dissipate at least a portion of its energy. For example, the structural component may present and the element 12 may compose or be communicatively coupled to a rigid outer shell 14, interior padding 16, and/or facemask/shield 18 composing the helmet 10. The term "interior padding 16" shall include all components of the helmet interior to the shell 14 and generally functional to protect the user during impact. As shown in FIGS. 1, 2, 3, and 10, the shell 14 includes a left side portion, a right side portion, and a dorsal portion defining a crown, wherein the left side portion, the dorsal portion, and the right side portion are viewable in the front elevation, and cooperatively define the exterior surface, wherein the dorsal portion is intermediate the left side portion and the right side portion, and is centered about the lateral centerline of the helmet in the front and back elevations. It is appreciated that the padding 16 may comprise a plurality of components differing in constituency, shape, performance, function, and/or location relative to the head of the user. The element 12 may take any suitable form, including wire formations (FIG. 1), wherein the term "wire" is meant to encompass a range of tensile geometric forms such as strands, strips, bands, cables, thin sheets or slabs, etc. Upon unloading at temperatures above the Austenitic finish temperature (Af), the SMA will revert back to the original shape (almost indefinitely), exhibiting pseudoelastic behavior.

As best shown in FIGS. 2 and 2*a*, the element 12 may further present an extendable active mesh or continuous planar sheet. In this configuration, the mesh 12 is formed by interconnected folded or sinuous wires 20 that where receiving an increasing normal load are caused to mechanically deform and straighten under Austenitic elastic behavior, to transform to the Martensite phase, to further straighten under Martensitic elastic behavior, and then to exhibit up to 8% strain in the Martensite phase. More preferably, a continuous sheet of the active material element 12 is used (FIG. 2*a*), so as to increase the energy dissipating capability of the helmet 10. Where superelastic SMA is used within its bounds, it is appreciated that unloading the helmet 10 results in a reversion of the element 12 to the Austenite phase and its original shape, or an attempt to do the same.

Figure 10:
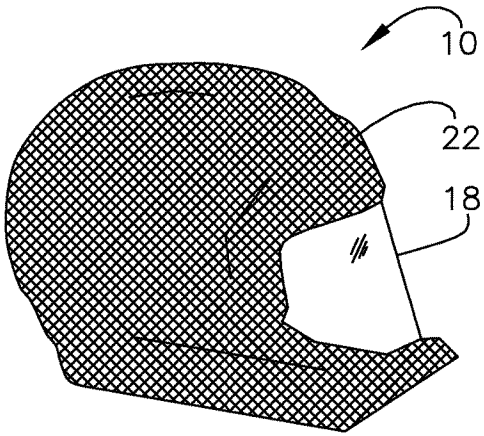
FIG. 10 is a perspective view of a motorcycle helmet presenting energy dissipation along its entire outer surface, in accordance with a preferred embodiment of the invention.

As shown in FIGS. 1, 2, 2 *a*, 4, and 6-11, the element 12 may be disposed within the rigid outer shell 14, and may co-extend with the shell 14 or be limited to that part or section of the shell 14 anticipated to receive the impact. Where limited, the helmet 10 thus defines energy dissipating and non-active sections or parts 22,24. The non-active section(s) 24 is otherwise conventionally structured and functional (and will not be further discussed herein). Thus, it is appreciated that the compliant energy dissipating section 22 dissipates at least a portion of energy and achieves an impact condition, when receiving the anticipatory impact, while the non-active section 14 does not dissipate a portion of energy and does not achieve the impact condition, when receiving the anticipatory impact. For example, the shell 14 of a football helmet 10 may present a dorsal energy dissipating section 22 (as shown in FIGS. 1-3, and 10), a baseball helmet 10 may present side energy dissipating sections 22 (FIGS. 6, 7), a hockey helmet may present front and back energy dissipating sections 22 (FIG. 8), a construction hard hat 10 may present a top energy dissipating section 22 (FIG. 9); and a motorcycle helmet 20 may present energy dissipation over its entire exterior surface (FIG. 10). As shown in FIGS. 1, 2, and 3, the energy dissipating section 22 may be laterally centered within the dorsal portion of the shell 14, and spaced from the facemask 18.

As shown in FIGS. 3, and 6-11, and appreciated by one of ordinary skill in the art, the left side portion, the right side portion, and the dorsal portion of the shell 14 may be integrally formed such that the shell presents a unitary and non-modular structure. More preferably, the energy dissipating and non-active sections 22,24 are facilely and reversibly disconnectable. For example, the energy dissipating and non-active sections 22,24 may be selectively inter-engaged by a plurality of retractable pins or dowels 26 (FIGS. 1-2). In this configuration, the pins 26 may be (e.g., spring) biased towards the extended conditions shown, but manually retracted into receptacles (not shown) defined by the other of the sections 22,24 when disassembly is desired. Suitable linkage, transmission, and/or other means to effect retraction are readily discerned by those of ordinary skill in the art, and may include a lever and bar linkage system. It is appreciated that disassembly may be performed to repair or replace the energy dissipating section 22. The helmet 10 is structurally configured such that anticipatory impacts are able to transfer sufficient loading to the element 12 to cause it to activate (e.g., transform fully from Austenite to Martensite phase) without disassembly or failure of the helmet 10. For example, it is appreciated that a 200 MPa stress and 5% strain will spontaneously transform mean Austenitic SMA to Martensitic SMA, where it will then be able to undergo further strain, exhibiting superelastic behavior.

In another aspect of the invention, the energy dissipating section 22 may be further formed of a material operable to facilitate repair, such as a shape memory polymer (SMP). That is to say, it is certainly within the ambit of the present invention for the energy dissipating section 22 to comprise SMP so as to facilitate repair, whereas energy absorption is accomplished conventionally and the assembly 10 is devoid of a stress-activated active material (e.g., SMA). In this configuration, the SMP constituent material provides the section 22 with the ability to remember and achieve its original shape simply by heating the polymer past its activation temperature (e.g., glass transition temperature range). As is appreciated by those of ordinary skill in the art, thermally-activated shape memory polymers (SMP's) generally refer to a group of polymeric active materials that demonstrate the ability to return to a previously defined shape when subjected to an appropriate thermal stimulus. Their elastic modulus changes substantially (usually by one-three orders of magnitude) across a narrow transition temperature range, which can be adjusted to lie within a wide range that includes the interval 0 to 150° C. by varying the composition of the polymer.

Generally, SMP's have two main segments, a hard segment and a soft segment. The previously defined or permanent shape can be set by melting or processing the polymer at a temperature higher than the highest thermal transition followed by cooling below that thermal transition temperature. The highest thermal transition is usually the glass transition temperature ($T_g$) or melting point of the hard segment. A temporary shape can be set by heating the material to a temperature higher than the $T_g$ or the transition temperature of the soft segment, but lower than the $T_g$ or melting point of the hard segment. The temporary shape is set while processing the material above the transition temperature of the soft segment followed by cooling to fix the shape. The material can be reverted back to the permanent shape by heating the material above the transition temperature of the soft segment.

More particularly, where the rigid outer shell 14 is formed of a thin layer of SMP (having an Austenitic SMA mesh or sheet 12 disposed therein), and caused to be permanently deformed (i.e., inelastically deformed) by the impact as shown in FIG. 3, it may be repaired simply by unloading and heating the section 22 past the glass transition temperature of its soft segment in order to achieve the original shape (FIG. 1). In a football setting, for example, a deformed energy dissipating section 22 (FIG. 3) may be removed from the helmet 10, passed through a heater or oven, allowed to cool, and then reassembled on the sideline. Alternatively, it is appreciated that a hand-held heater (e.g., blow dryer) may be used to heat the shell 14. Here, the shell 14 and the return force of the element 12 may be cooperatively configured so as to manipulate the SMP only when in the SMP is in its more malleable state.

Though it is appreciated that Austenitic SMA provides a two-way effect when deactivated, a return element 28 may comprise the energy dissipating section 22, so as to aid in its return to its original shape. For example, as shown in FIG. 2, a return mesh 28 (e.g., formed of elastic fibers or sheaths) may be interposed with the active mesh 12 to drive both the return of the active mesh 12 to a more folded or compressed state once extended, and the shell section 22 to its original shape when deformed. It is appreciated that, the return mesh 28 adds to the structural integrity of the shell 14.

More preferably, a composite shell 14 is formed by inner and outer layers 30,32 spaced by a collapsible medium 34 or air. Here, the outer layer 30 may present the rigid outer shell configuration previously described, while the inner layer presents a hard conventional shell that does not deform or crumple under the impact. The outer layer 30 is preferably formed of a compliant yet durable material, such as a thin layer of hard plastic. Air interposed between the layers 30,32 and through-holes (not shown) allow the outer layer 30 to resistively collapse towards the inner layer during impact (FIG. 2 *a*). Where SMA is employed, the spacing is configured to allow the element to achieve up to 8% strain. For example, and as shown in FIG. 1-3, a football helmet 10 may present a raised dorsal energy dissipating section 22 comprising inner and outer layers 30,32 spaced by air, wherein the outer layer 30 is formed of SMP and includes an Austenitic SMA sheet 12 disposed within the neutral axis of the SMP. It is appreciated that the collapsed or crumpled state of the outer layer 30 provides a visual indication that the helmet 10 has properly functioned to dissipate energy. It is further appreciated that the SMP outer layer 30 may be used without the use of SMA in the remainder of the helmet, such that energy dissipation is performed solely by the "crumpling" action of the outer layer 30. Thus, the present invention contemplates energy dissipating through deformation of the shell itself, wherein the energy dissipating section 22 is devoid of, and energy is not dissipated by an external attachment, and wherein the energy dissipating section is devoid of, and the energy is not dissipated by an internal element disposed intermediate the shell 14 and user. It is yet further appreciated that the outer layer 30 may be geometrically configured to facilitate crumpling, and more preferably, to control deformation under impact (e.g., may present lateral slopes that distend from a general fold in a dorsal application, so as to deter purely dorsal impacts). Finally, it is appreciated that existing helmets may be retrofitted in this manner by removably attaching (e.g., via existing screws located in the front and rear of the helmet, etc.) or fixing an SMP outer shell to and cooperatively defining an interior space with the existing outer shell of the pre-existing helmet.

Figure 4:
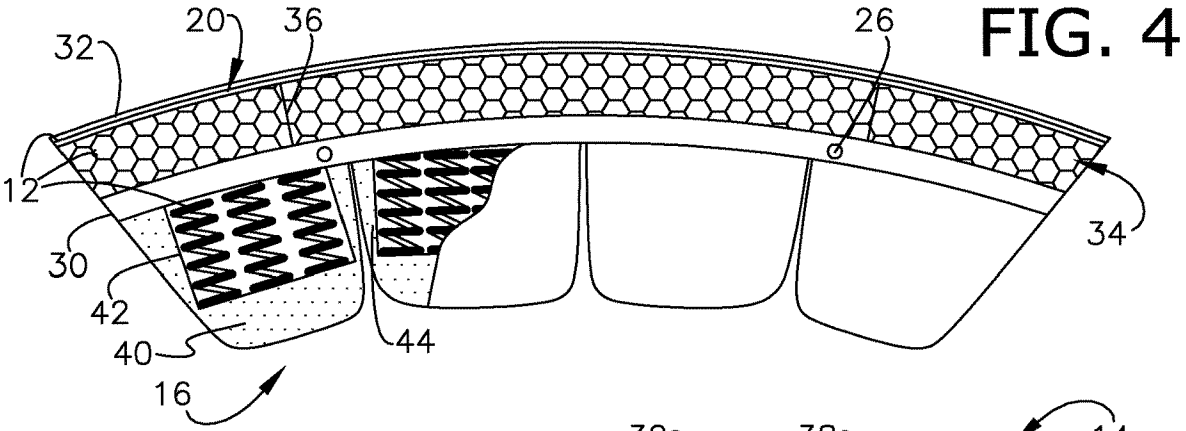
FIG. 4 is an exemplary cross-section of an energy dissipating section taken along line A-A in FIG. 1, illustrating an outer shell comprising outer and inner layers spaced by an active medium, and interior padding comprising non-active cushion material and active material springs or coils disposed within cutouts defined by the material, in accordance with a preferred embodiment of the invention.

In lieu of air, a compressible or viscous medium 34 may be interposed between the layers 30,32 to provide energy absorption. More preferably, the medium 34 is formed at least in part by the active material element 12 (FIG. 4) to provide further energy dissipation. For example, the medium 34 may define a cross-sectional cellular matrix formed of Austenitic SMA, such as the honeycomb pattern shown in FIG. 4. In this configuration, the outer layer 30 and medium 34 are collapsible by the impact, and configured to locally deform under the loading of the impact. Here, the outer layer 30 may be formed of a more compliant material, such as leather, or a vinyl sheet fixedly adhered to the medium 34. As previously described, the outer layer 30 may further include an Austenitic SMA mesh 12 for added energy dissipation (FIG. 4). In this configuration, the return element 28 may consists of tubular elastic members positioned within cell of the matrix 34, or a plurality of compression springs drivenly coupled and orthogonally oriented relative to the engaging surface of the medium 34 (preferably at nodes or vertices defined thereby).

Figure 4A:
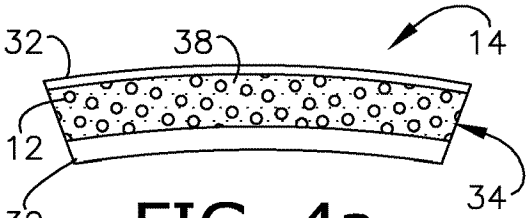
FIG. 4*a* is an exemplary cross-section of an energy dissipating section comprising an outer shell formed of outer and inner layers spaced by an active medium further comprising a plurality of active spheres embedded within a compressible substrate, in accordance with a preferred embodiment of the invention.

Alternatively, the medium 34 may include a plurality of hollow Austenitic SMA spheres or capsules 12, each collapsible by an impact (FIG. 4*a*). The spheres 12 are preferably confined so as to prevent migration, and maximize the conversion of impact energy to sphere deformation. To aid in this, the medium 34 may be bifurcated and supported by collapsible sectioning walls 36 (FIGS. 4 and 4*a*). In yet another alternative, the medium 34 may further include a compressible substrate 38, wherein the spheres 12 are fixedly embedded (FIG. 4*a*).

As previously mentioned, the active material element 12 may compose the compressible interior padding 16, so as to improve energy dissipation from within the shell 14. As shown in FIG. 1, for example, pre-existing padding 16 may be retrofitted by entraining Austenitic SMA wire 12*a* within otherwise non-active cushion material (i.e., "cushion") 40. Individual wire passes may be stand-alone or intertwined to form a geometric shape, webbing, or mesh. The wires 12*a* are fixedly anchored to the shell 14 through reinforced connection able to withstand the maximum tensile loads experienced thereby. The wires 12*a* may be attached to the shell 14 prior to placing the padding 16. The existing padding 16 may be caused to define narrow cutouts (not shown) (e.g., through laser etching, etc.) that match the configuration of the wires 12*a*, so as to depose the wires 12*a* at a predetermined depth within the cushion material 40.

The wire(s) 12*a* are preferably pre-strained so as to eliminate slack and produce a more instantaneous response. That is to say, when an anticipatory impact strikes the helmet 10 and the head of the user is caused to compress the padding 16, the preferred wire(s) 12*a* will be immediately caused to stretch, thereby invoking a tensile stress operable to trigger transformation to the more malleable Martensite phase. Once transformed, it is appreciated that the Martensite wire 12*a* will be further able to strain up to 8%. The padding 16 and wire(s) 12*a* are cooperatively configured such that the wires 12*a* do not interfere with the function of the padding 16, and the wires 12*a* are able to completely transform and achieve their maximum strain. More preferably, the cushion material 40 and wires 12*a* are cooperatively configured such that the impact causes the cushion material 40 to partially compress prior to transforming the wires 12*a*, and then further compress after the wires 12*a* have been fully transformed and strained.

Figure 4B:
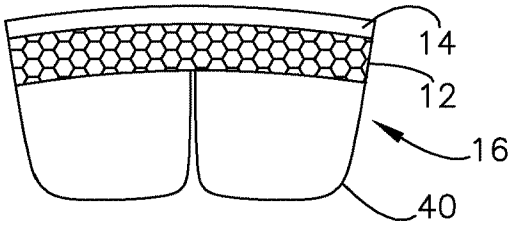
FIG. 4*b* is an exemplary cross-section of an energy dissipating section comprising an outer shell, a compressible active layer disposed adjacent the shell, and non-active cushion material adjacent the layer, in accordance with a preferred embodiment of the invention.
Figure 4C:
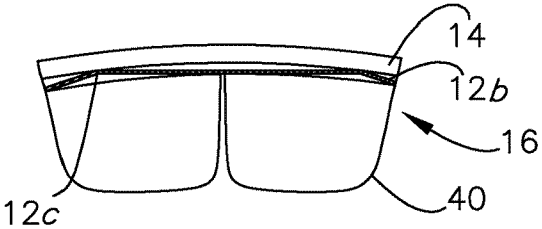
FIG. 4*c* is an exemplary cross-section of an energy dissipating section comprising an outer shell, an active polygonal sheet defining faces and vertices fixedly coupled to the shell, and non-active cushion material adjacent the sheet, in accordance with a preferred embodiment of the invention.
Figure 8:
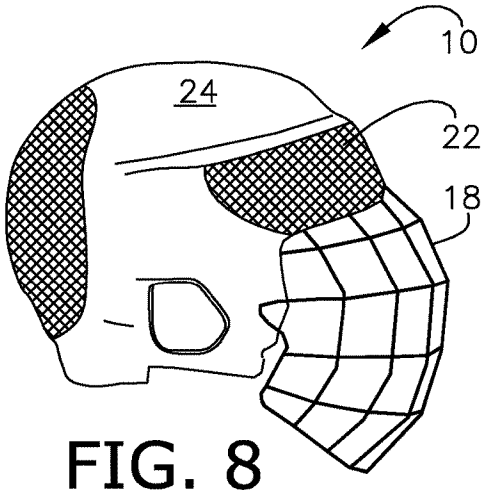
FIG. 8 is a side elevation of a hockey helmet including a facemask, and a shell further comprising front and back energy dissipating sections, and a non-active section, in accordance with a preferred embodiment of the invention.

In another embodiment, the interior padding 16 may include conventional non-active cushion material 40 and an active material layer 12 disposed intermediate and secured (e.g., fastened, coupled, adhesively bonded, etc.) to the shell 14 and/or cushion material 40 (FIGS. 4, 4*b*, and 4*c*). In this configuration, deformation of the active material layer 12 occurs from within the shell 14, as the head of the user bears upon the layer 12, during impact. In a first example, the layer 12 may present a thin planar Austenitic SMA sheet defining contours to match the cushion 40, wherein the layer 12 is spaced from the rigid outer shell 14, except, for example, at coupling supports (not shown), so as to generally enable the sheet 12 to strain and transform under the load. Alternatively, and as shown in FIG. 4*c*, an Austenitic SMA sheet defining polygonal faces 12*b* and vertices 12*c* may be intermediately placed between the shell 14 and cushion material 40, such that the faces 12*b* and not the vertices 12*c* are spaced from the shell 14. Means for preventing lateral migration by the layer 12, e.g., by fastening to the shell 14 near or along the edges of the layer 12 is necessarily provided, so as to effect the intended strain during impact. For example, cushion fasteners (not shown) may simply pass through the layer 12 thereby further anchoring the layer 12. In operation, the geometry of the polygons and shell 14 will produce the spacing necessary adjacent the faces 12*b*. It is appreciated that where an impact causes the head of the user to bear upon a face 12*b* (through the cushion 40), the sheet 12 will be caused to locally transform and bow, thereby encroaching the adjacent space, achieving superjacent layers with the shell 14 and cushion 40, and exhibiting up to 8% strain. Thus, during an impact, the layer 12 will dissipate energy through mechanical deformed in a breakaway manner, and through the phase transformation of the SMA triggered by the stress incurred in the material as it bears the load. To facilitate implementation, the preferred sheet or layer 12 is facilely compliant along the edges of the polygons (e.g., via etched fold lines), so as to generally achieve the contours of various conventional shell geometries (FIG. 4*c*), and expand its retrofitting/reconditioning capability. Moreover, it is appreciated that the layer 12 may be caused to achieve its more compliant Martensitic phase prior to assembly by lowering its temperature past the transformation temperature range.

In another embodiment, an active compressible layer (e.g., cellular matrix) may co-extend, so as to form superjacent layers with the entire interior surface of the shell 14 (FIG. 4*b*), or may be positioned only within energy dissipation sections 22, so as to reduce weight. In a first example, a compliant spring-mattress type layer 12 comprising energy-absorbing coils as further described below, may be positioned intermediate the interior surface of the shell 14 and non-active cushion material 40. In this configuration, the cushion material 40 defines at least one cutout 42, so as to form an enclosed cavity, and the element 12 presents at least one, and more preferably a plurality of compressible Austenitic SMA springs or coils disposed within each cutout 42 (FIG. 4). The cutout 42 is configured such that facilely compressible walls 44 about the cavity are created. This allows the majority of the compression force to act upon the springs 12. The springs 12 are configured such that compressive force necessary to generate the activation stress is not less than, and more preferably equal to the force necessary to compress the springs 12 in the Austenitic phase, so that compression and transformation occur contemporaneously or transformation lags partial compression. The spring geometry and SMA constituency may be cooperatively configured such that the springs 12, in their Austenite phase, present a spring modulus generally equivalent to the compressive force of conventional cushion material 40. As such, it is appreciated that the number of turns, pitch, and diameter of the spring wire shown in FIG. 4 may not reflect the preferred embodiment of the invention.

Figure 5:
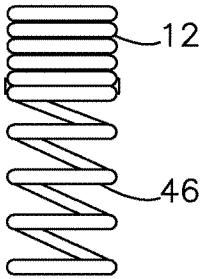
FIG. 5 is an elevation of an active material spring, such as those disposed within the cutouts shown in FIG. 4, in a collapsed condition and mechanically connected in series to a non-active spring, in accordance with a preferred embodiment of the invention.

Once transformation occurs, it is appreciated that the springs 12 will more readily compress under the lower spring modulus afforded by the Martensitic SMA and reduced cross-section of the walls 44 in comparison to conventional cushion material 40. Therefore, the preferred cushion material 40 presents enough volume to further compress after the springs 12 fully compress (FIG. 4). Alternatively, each active spring 12 may be connected in series to a conventional spring 46 presenting a higher modulus than the Martensitic spring 12, but comparable to the cushion material 40, so as to provide further compression after transformation where needed (FIG. 5). Thus, while the performance and compressibility of conventional interior padding may be maintained, the total amount of energy absorption/dissipation, under the present invention, is increased due to transforming the phase of the SMA material in addition to conventional mechanical deformation.

In addition to energy dissipation, the entire assembly is preferably operable to provide structural integrity, and comfort at least on par with those of conventional helmets. Finally, in either configuration, it is appreciated that the inventive helmet 10 may be configured to provide energy dissipation (e.g., undergo an SMA stress-activated phase transformation) when encountering a maximum, mean, or minimum anticipatory impact, wherein the term "maximum" shall define the limit of those impacts deemed safe for the user to endure without the intended benefits of the present invention, so that energy dissipation (e.g., SMA actuation cycle) is triggered only in excessive impact occurrences, and the term "minimum" shall mean any impact within the range of anticipatory impacts, so that energy dissipation is triggered by all anticipatory impacts.

Figure 11:
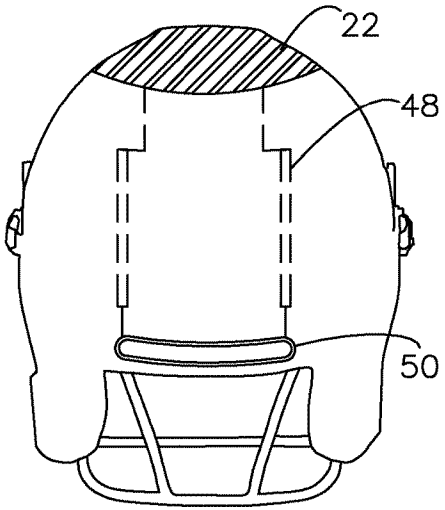
FIG. 11 is a back elevation of a football helmet comprising piezoelectric composite elements communicatively coupled to resistive elements and luminaries, in accordance with a preferred embodiment of the invention.
Figure 9:
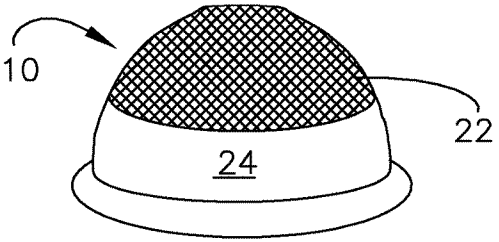
FIG. 9 is a perspective view of a construction, factory, or military hard hat/helmet comprising a top energy dissipating section, in accordance with a preferred embodiment of the invention.
Figure 6:
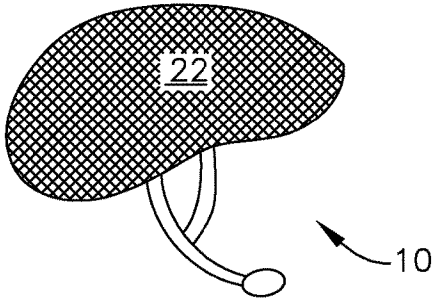
FIG. 6 is a side elevation of a bicycle helmet comprising energy dissipation along its entire outer surface, in accordance with a preferred embodiment of the invention.
Figure 7:
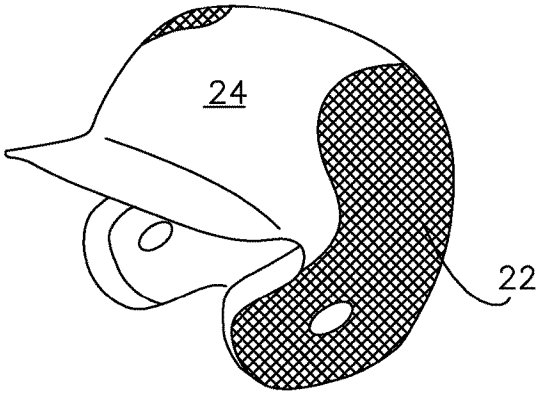
FIG. 7 is a perspective view of a baseball helmet comprising side energy dissipating sections, and a dorsal non-active section, in accordance with a preferred embodiment of the invention.

In yet another embodiment of the invention, it is appreciated that piezoelectric ceramics/composites 12, preferably composing the outer shell 14, may be used to convert a change in pressure into electricity that is then dissipated through resistive elements 48 as heat, and/or through luminaries (e.g., LED's) 50 as light, wherein the resistive elements 48 and/or luminaries 50 compose the helmet 10 (FIG. 11). The lights may also serve to alert interested parties that the user has sustained an impact to the head, which, for example, in a football setting, may be used to teach proper tackling technique. It is appreciated that the piezoelectric activation may be used to drive an audible alert in addition to or lieu of a visual alert.

Piezoelectric ceramics include PZN, PLZT, and PNZT. PZN ceramic materials are zinc-modified, lead niobate compositions that exhibit electrostrictive or relaxor behavior when non-linear strain occurs. The relaxor piezoelectric ceramic materials exhibit a high-dielectric constant over a range of temperatures during the transition from the ferroelectric phase to the paraelectric phase. PLZT piezoelectric ceramics were developed for moderate power applications, but can also be used in ultrasonic applications. PLZT materials are formed by adding lanthanum ions to a PZT composition. PNZT ceramic materials are formed by adding niobium ions to a PZT composition. PNZT ceramic materials are applied in high-sensitivity applications such as hydrophones, sounders and loudspeakers.

Piezoelectric ceramics include quartz, which is available in mined-mineral form and man-made fused quartz forms. Fused quartz is a high-purity, crystalline form of silica used in specialized applications such as semiconductor wafer boats, furnace tubes, bell jars or quartzware, silicon melt crucibles, high-performance materials, and high-temperature products. Piezoelectric ceramics such as single-crystal quartz are also available.

The preferred forms of the invention described above are to be used as illustration only, and should not be utilized in a limiting sense in interpreting the scope of the present invention. Obvious modifications to the exemplary embodiments and methods of operation, as set forth herein, could be readily made by those skilled in the art without departing from the spirit of the present invention. The inventor hereby states his intent to rely on the Doctrine of Equivalents to determine and assess the reasonably fair scope of the present invention as pertains to any system or method not materially departing from but outside the literal scope of the invention as set forth in the following claims.

Additionally, the terms "a" and "an" herein do not denote a limitation of quantity, but rather denote the presence of at least one of the referenced item. The suffix "(s)" as used herein is intended to include both the singular and the plural of the term that it modifies, thereby including one or more of that term. Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. It is to be understood that the described elements may be combined in any suitable manner in the various embodiments.

What is claimed is:

1. A protective football helmet configured to fit upon the head of a user, to receive an anticipatory impact having energy on a predefined area of the helmet, and to dissipate a portion of the energy, so as to not transfer said portion of the energy to the user, when the helmet is donned and the impact is received on said predefined area, said football helmet comprising:

an outer shell of hard plastic defining a continuous exterior surface adapted to receive the anticipatory impact when the helmet is donned, presenting a front elevation, and including a left side portion, a right side portion, and a dorsal portion defining a crown, wherein the left side portion, the dorsal portion, and the right side portion are viewable in the front elevation, and cooperatively define the continuous exterior surface, and wherein the dorsal portion is intermediate the left side portion and the right side portion, said shell defining a rigid, non-active section in each of said left side portion and right side portion, wherein the non-active section is operable to provide structural integrity to the helmet, when receiving the anticipatory impact, said shell further defining at least one compliant energy dissipating section disposed within the front elevation and the dorsal portion, said at least one compliant energy dissipating section has a length and a width, the length extending along the dorsal portion between the front and back portion of the helmet, and said at least one compliant energy dissipating section configured to be deformed by the anticipatory impact, so as to dissipate at least a portion of the energy when receiving the anticipatory impact, wherein said at least one compliant energy dissipating section is configured to resistively collapse towards the head of the user when receiving the anticipatory impact, said at least one compliant energy dissipating section and non-active section being cooperatively configured, such that said at least one compliant energy dissipating section undergoes a greater amount of deformation than does the non-active section when each section receives the anticipatory impact, and said at least one compliant energy dissipating section dissipates said portion of the energy and achieves an impact condition, when receiving the anticipatory impact, and said non-active section does not dissipate said portion of the energy and does not achieve the impact condition, when receiving the anticipatory impact;

interior padding adapted to engage the head of the user when the helmet is donned, and configured to be compressed when the shell receives the anticipatory impact; and a facemask.

2. The helmet as claimed in claim 1, wherein said at least one compliant energy dissipating section is laterally centered within the dorsal portion.

3. The helmet as claimed in claim 1, wherein the shell is formed of an injection molded hard plastic, such that the non-active section in each of said left side portion and right side portion, and said at least one compliant energy dissipating section are formed of the injection molded hard plastic.

4. The helmet as claimed in claim 1, wherein the left side portion, the right side portion, and the dorsal portion cooperatively define, in the front elevation, an inverted U-shaped opening operable to receive the facemask, wherein the opening is defined by opposite vertical edges defined by the left side portion and the right side portion, and an interconnecting cross-edge defined by the left side portion, the right side portion, and the dorsal portion, and said at least one compliant energy dissipating section is spaced from the opening.

5. The helmet as claimed in claim 1, wherein said at least one compliant energy dissipating section defines through-holes within the shell, said through-holes being configured such that said at least one compliant energy dissipating section resistively collapses towards the head of the user when receiving the anticipatory impact.

6. The helmet as claimed in claim 1, wherein the left side portion, the right side portion and the dorsal portion are integrally formed, such that the shell presents a unitary and non-modular structure.

7. The helmet as claimed in claim 1, wherein said at least one energy dissipating section inelastically deform as a result of receiving the anticipatory impact.

8. The helmet as claimed in claim 1, wherein the energy dissipating section presents an original shape and achieves a deformed shape as a result of the anticipatory impact, and includes a return element configured to drive the energy dissipating section towards the original shape, when in the deformed shape.

9. The helmet as claimed in claim 1, wherein said shell and padding are cooperatively configured such that the padding achieves a thinner collapsed profile adjacent said at least one compliant energy dissipating section than it does adjacent the non-active section.

10. The helmet as claimed in claim 1, wherein said at least one compliant energy dissipating section presents at least one of a geometric configuration, a thin layer of hard plastic, or at least one fold operable to cause said energy dissipating section to resistively collapse towards the head of the user, when said compliant energy dissipating section receives the anticipatory impact.

11. The helmet as claimed in claim 1, wherein said at least one compliant energy dissipating section and the non-active sections form separate interconnected parts, so as to define a seam between said at least one dissipating section and the non-active sections.

12. The helmet as claimed in claim 1, wherein the shell presents opposite front and back elevations, and said at least one compliant energy dissipating section is viewable in the front and back elevations.

13. The helmet as claimed in claim 1, wherein the shell, in said at least one compliant energy dissipating section, presents a composite shell including an inner layer and an outer layer spaced from the inner layer, and the outer layer is caused to resistively collapse towards the inner layer by the impact.

14. The helmet as claimed in claim 13, wherein the shell further includes a compressible medium interposed between the inner and outer layers to provide further energy absorption.

15. A protective football helmet configured to fit upon the head of a user, to receive an anticipatory impact having energy on a predefined area of the helmet, and to dissipate a portion of the energy, so as to not transfer said portion of the energy to the user, when the helmet is donned and the impact is received on said predefined area, said football helmet comprising:

an outer shell of durable material defining a continuous exterior surface adapted to receive the anticipatory impact when the helmet is donned, presenting opposite front and back elevations, and including a left side portion, a right side portion, and a dorsal portion defining a crown, wherein the left side portion, the dorsal portion, and the right side portion are viewable in the front and back elevations, and cooperatively define the exterior surface, wherein the dorsal portion is intermediate the left side portion and the right side portion and is centered about the lateral centerline of the helmet in the front and back elevations, said shell defining a rigid, non-active section in each of said left side portion and right side portion, wherein the non-active section is operable to provide structural integrity when receiving the anticipatory impact, said shell further defining at least one compliant energy dissipating section disposed within the front elevation and the dorsal portion, said at least one compliant energy dissipating section has a length and a width, the length extending along the dorsal portion between the front and back portion of the helmet, and said at least one compliant energy dissipating section configured to be deformed by the anticipatory impact, so as to dissipate a portion of the energy when receiving the anticipatory impact, wherein said at least one compliant energy dissipating section is configured to resistively collapse towards the head of the user when receiving the anticipatory impact, said at least one compliant energy dissipating section and non-active section being cooperatively configured, such that said at least one compliant energy dissipating section undergoes a greater amount of deformation than does the non-active section when each section receives the anticipatory impact, and said at least one compliant energy dissipating section dissipates said portion of the energy and achieves an impact condition, when receiving the anticipatory impact, and said non-active section does not dissipate said portion of the energy and does not achieve the impact condition, when receiving the anticipatory impact;

interior padding adapted to engage the head of the user when the helmet is donned, and configured to be compressed when the shell receives the anticipatory impact, a facemask spaced from said at least one compliant energy dissipating section, wherein the shell is formed of an injection molded hard plastic, such that the non-active section in each of said left side portion and right side portion, and said at least one compliant energy dissipating section are formed of the injection molded hard plastic, wherein the left side portion, the right side portion, and the dorsal portion cooperatively define, in the front elevation, an inverted U-shaped opening operable to receive a facemask, wherein the opening is defined by opposite vertical edges defined by the left side portion and the right side portion and an interconnecting cross-edge defined by the left side portion, the right side portion, and the dorsal portion, and said at least one compliant energy dissipating section is spaced from the opening.

* * * * *